US012385256B1

(12) United States Patent
Bazan

(10) Patent No.: US 12,385,256 B1
(45) Date of Patent: Aug. 12, 2025

(54) ENVIRONMENTALLY FRIENDLY AUTOMATIC SHADE ACTUATING SYSTEM

(71) Applicant: Diego M. Bazan, Hallandale Beach, FL (US)

(72) Inventor: Diego M. Bazan, Hallandale Beach, FL (US)

( * ) Notice: Subject to any disclaimer, the term of this patent is extended or adjusted under 35 U.S.C. 154(b) by 221 days.

(21) Appl. No.: 18/207,926

(22) Filed: Jun. 9, 2023

(51) Int. Cl.
*E04F 10/10* (2006.01)

(52) U.S. Cl.
CPC ..... *E04F 10/10* (2013.01)

(58) Field of Classification Search
CPC ..... E04F 10/10; E06B 9/032; E06B 7/084; E04B 7/163
See application file for complete search history.

(56) References Cited

U.S. PATENT DOCUMENTS 2,489,879 A * 11/1949 Grebe ..... E05F 1/004 236/49.5
3,403,472 A * 10/1968 De Raucourt ..... E05F 15/71 236/49.5
4,143,640 A * 3/1979 Pierce ..... F24S 23/74 126/633
4,210,279 A * 7/1980 McSwain ..... F24F 11/76 236/49.5
4,243,175 A * 1/1981 McSwain ..... F24F 11/76 454/258
4,279,240 A * 7/1981 Artusy ..... F24S 20/61 126/579
4,644,990 A * 2/1987 Webb, Sr. ..... E06B 9/32 160/5
4,739,748 A * 4/1988 Stice ..... F24S 20/63 126/633
5,063,984 A * 11/1991 Cherveny ..... E06B 9/70 340/595
5,280,818 A * 1/1994 Ubelhart ..... E06B 9/68 160/322
8,650,877 B1 * 2/2014 Gustafson ..... F03G 6/00 60/641.8
9,410,365 B2 * 8/2016 Hashemi ..... E06B 9/302
9,702,592 B2 * 7/2017 Reid ..... F24S 50/20
11,193,326 B1 * 12/2021 Neumann ..... E06B 9/264
12,006,693 B2 * 6/2024 Abeel ..... H05B 3/40
(Continued)

*Primary Examiner* — Beth A Stephan
(74) *Attorney, Agent, or Firm* — Sanchelima & Associates, P.A.; Jesus Sanchelima; Christian Sanchelima

(57) ABSTRACT

The present invention describes an automatic shade actuating system that includes a supporting structure and at least one hollow slat connected to it. The slat encloses a gas and is designed to rotate through a movable assembly located at its distal end. The movable assembly comprises a pressure-sensitive element and a receiving member connected by a thread. The periphery of the pressure-sensitive element is sealed and pressed against the slat's interior. The receiving member is attached to the supporting structure by fasteners, and a fixing bracket with a pivot axis allows the slat to rotate. When the gas inside the slat heats up, it expands, thereby pressing the pressure-sensitive element inside the receiving member. The pressure applied by the gas during expansion drives the pressure-sensitive element to rotate as it follows the thread, resulting in the rotation of the slat.

9 Claims, 6 Drawing Sheets

(56) References Cited

U.S. PATENT DOCUMENTS

| | | | | |
|---|---|---|---|---|
| 2005/0284588 | A1* | 12/2005 | Blonder | A47G 19/2227 428/212 |
| 2009/0167971 | A1* | 7/2009 | Powers | G02B 13/06 349/18 |
| 2010/0058672 | A1* | 3/2010 | Bayne | A01G 9/241 52/2.11 |
| 2015/0191959 | A1 | 7/2015 | Schmohl | |
| 2016/0211793 | A1* | 7/2016 | Grimmeisen | H02S 20/30 |
| 2020/0113297 | A1 | 4/2020 | Gharabegian | |

* cited by examiner

ENVIRONMENTALLY FRIENDLY AUTOMATIC SHADE ACTUATING SYSTEM

BACKGROUND OF THE INVENTION

1. Field of the Invention

The present invention relates to a parasol and, more particularly, to a parasol that includes a plurality of slats, wherein each slat comprises a mobile and fixed component and is hollowed to encase a gas. The sun's heat engenders the expansion of the gas within the slat, instigating movement of the pressure piston, thereby altering the angle of the slat to regulate the shade.

2. Description of the Related Art

Several designs disclosing a shading device can be found in the state of art. Wherein The shading device includes a container filled with a thermal expandable medium; a hydraulic cylinder having a cylinder body, a piston movable within the cylinder body, and a piston rod connected to the movable piston, the pressure chamber of the hydraulic cylinder being in fluid connection with the container; and shading means operable between an active shading position and a non-active non-shading position, the piston rod being coupled to the shading means to control the position of the shading means have been designed in the past. None of them, however, include an environmentally friendly automatic shade actuating system, comprising a supporting structure; at least one slat; a movable assembly; a pressure sensitive element mechanically connected to a receiving member by means of a thread and a fixing bracket.

Applicant believes that a related reference corresponds to U.S. patent application No. 2015/0191959 issued for a sun protective device which discloses a sun protection device having sun protection elements. The sun protection elements have a housing in which a flexible membrane is arranged. The sun protection element is connected to a reservoir containing a hydraulic fluid using a hydraulic line, where the membrane is adapted to extend from the housing if the pressure in the hydraulic line increases. Applicant believes that another related reference corresponds to U.S. patent application No. 2020/0113297 issued for an automated umbrella, which discloses an intelligent shading object. The intelligent shading object includes a plurality of shading elements, a shading element deployment mechanism, a support structure, and a base unit. An actuator is operated by a source of energy, such as fluid or pneumatic pressure that is converted into mechanical energy. None of these references, however, teach of an environmentally friendly automatic shade actuating system, comprising a supporting structure; at least one slat; a movable assembly; a pressure sensitive element mechanically connected to a receiving member by means of a thread. Wherein the slat houses a gas and said pressure sensitive element. Expansion and retraction of the gas due to environmental conditions adjusts the angle of the slat by means of the pressure sensitive element.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a system that harmonizes with the environment in which we live and achieve projected comfort.

It is another object of this invention to provide an autonomous parasol that consumes no electric energy for operating, as its functionality is subject to natural properties of gasses, and its interaction with a heat source, namely the sun.

It is still another object of the present invention to provide an environmentally friendly automatic shade actuating system that is designed to be used at different latitudes around the world. Always with a specific calculation on the side of the building that receives the most sunlight. This is a factor that will directly affect the rotation of the system and the speed of its action.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
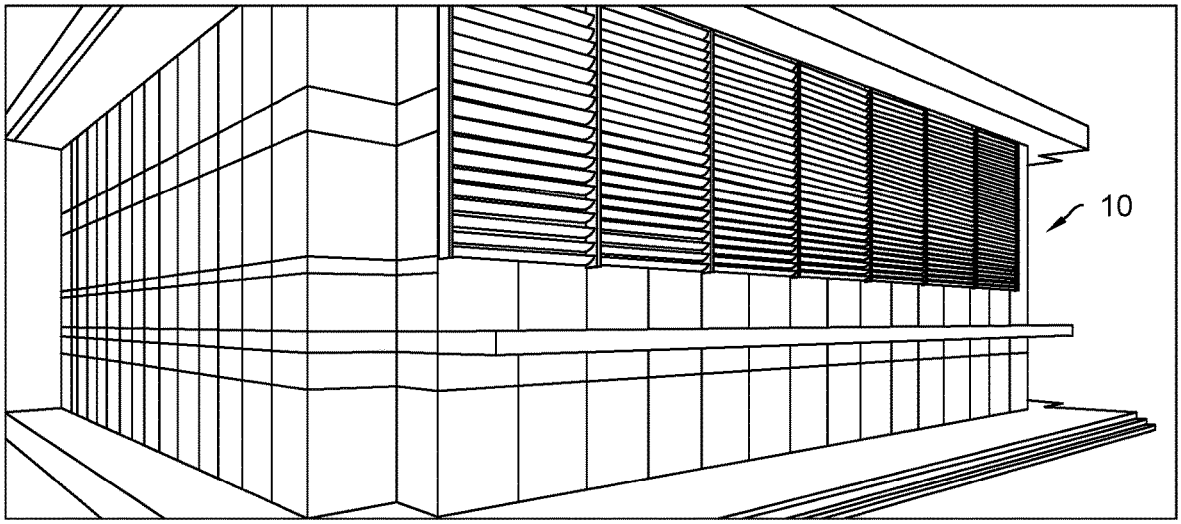
FIG. 1 represents an operational view of the present invention 10

Referring now to the drawings, where the present invention is generally referred to with numeral 10, it can be observed that it basically includes a supporting structure 20 (also termed as frame), at least one slat 30, a movable assembly 40, a fixing assembly 50, fasteners 60, a sealing assembly 70, and a gas G. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2A:
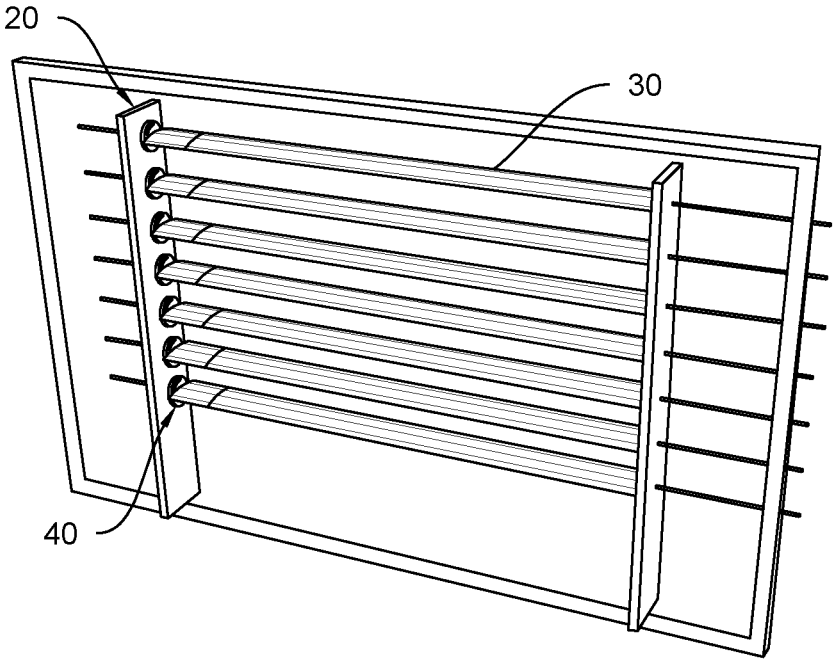
FIG. 2A shows an exemplary embodiment of the present invention in initial conditions
Figure 2B:
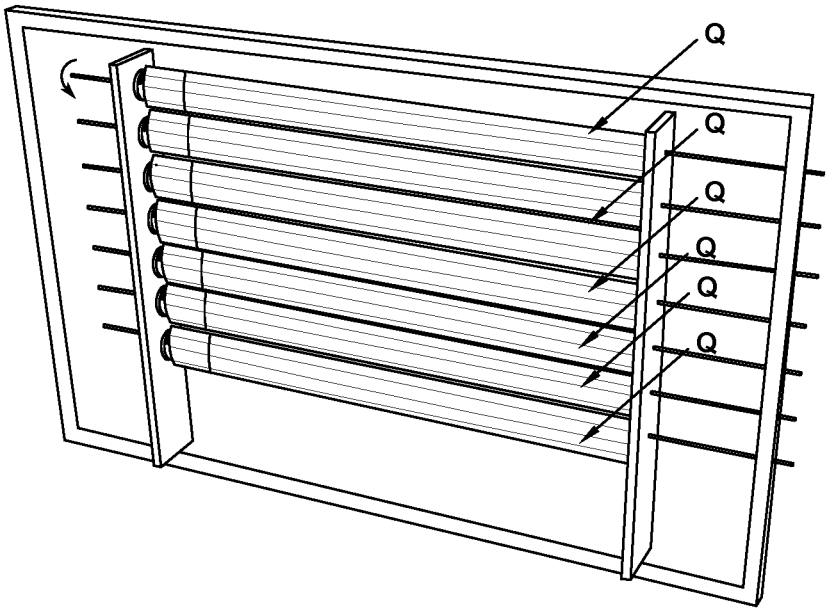
FIG. 2B shows the exemplary embodiment of FIG. 2 after heat Q is added to the system, causing the slats to rotate.

FIG. 1 shows an exemplary embodiment of the present invention mounted onto the building's facade such that the system may be driven by the amount of sunlight received thereon. In exemplary FIGS. 2A and 2B, it is presented an isolated section showing the supporting structure 20, at least one slant 30, and part of the movable assembly 40. Wherein exemplary FIG. 2A may depict the present invention 10 in initial conditions, this is, no external heat Q has been added;

and exemplary FIG. 2B may show the system in a final position after heat Q is added to the system 10. The shade angle of the slat 30 may vary based on the heat Q received on its surface, wherein the movable assembly 40 may act as the means to vary the angle. As widely known in the art, the shade angle is the angle at which the slat is tilted, which determines the amount of sunlight or shade that passes through the slat. For example, if the slat is tilted at a 45-degree angle, it will block out more sunlight than if it were tilted at a shallower angle.

Referring now to the supporting structure 20 also termed as frame, may be a part of the invention used to support the slats. The frame 20 may be made of metal, wood, plastics, natural or synthetic fibers, engineering materials, or any other suitable material depending on the desired strength, durability and aesthetic thereof. In one embodiment, the frame 20 may consist of a series of horizontal and/or vertical members that are assembled together to create a stable and rigid structure. The supporting structure 20 may be designed to be mounted upon a surface such as the building's facade as shown in exemplary FIG. 1. In one exemplary embodiment, the frame 20 may include lateral members that are separated by a predetermined distance wherein the at least one slat 30 is attached therebetween. In another embodiment, the frame 20 may include horizontal members at the bottom and at the top of the lateral members to add structural support. In one embodiment, the frame 20 may be sturdy and durable and configured to withstand the weight of the slats and/or any other environmental stresses that may be placed upon it.

Figure 6A:
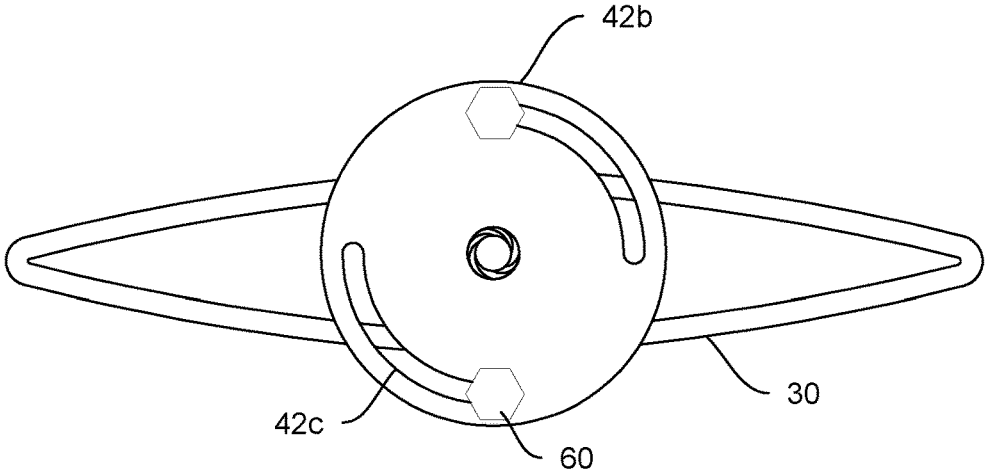
FIG. 6A is a perspective view of the at least one slat in horizontal configuration and the base having the slots in an exemplary configuration.
Figure 6B:
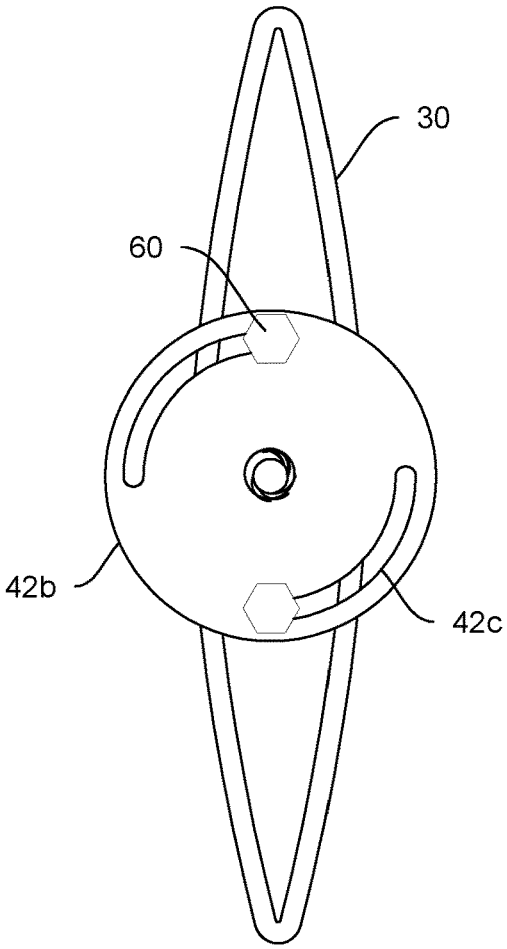
FIG. 6B is a perspective view of the at least one slat in vertical configuration and the base having the slots in an exemplary configuration.

The at least one slat 30 may be a type of extruded profile that is commonly used in various applications such as fencing, trellises, parasoles, or the like. In one embodiment, the at least one slat 30 may be made of a lightweight and durable material. The slat 30 may be made of aluminum, plastic, natural/synthetic fibers, engineering materials, or the like. Based on the operational requirements that the slat 30 may be subject to, in one embodiment the slat may be made of a material with high thermal conductivity; in other embodiments, the slat 30 may be made of a material that may exhibit a lower thermal conductivity coefficient. The slat 30 may be hollow as depicted in exemplary FIG. 4 to house a gas G therewithin. In a preferred embodiment said gas is nitrogen, nonetheless, other suitable gasses may be used. The slat 30 being hollow, may reduce weight and provide flexibility, making it easier to handle and install, while also reducing material costs. In a preferred embodiment, the at least one slat 30 may have an oval cross-section with pointed distal ends as depicted in FIGS. 6A-6B. The slat 30 having the oval cross-section with pointed distal ends may provide increased rigidity and strength while also allowing for greater flexibility and movement. Nonetheless, in other suitable embodiments, the slat 30 may have any other suitable cross-section suitable to provide a shaded surface. The slat 30 may be extruded in a continuous length and cut to the desired size and length for the intended application. In one embodiment, the slat 30 may be finished with a variety of surface treatments, such as powder coating, anodizing, or painting, to enhance its durability and resistance to the elements. As the slat 30 may enclose the gas G, its thermal properties will be critical to ensure that the gas is stored and maintained at the desired temperature and pressure. Customizing the slat 30 to achieve predetermined thermal properties may involve several factors such as the choice of material, or the like. In one embodiment, the choice of material may impact the heat transfer and temperature regulation of the gas G. In an exemplary embodiment, surface treatments may also be used to customize the slat's thermal properties. For example, a reflective coating may help to reduce heat absorption, while an absorptive coating may help to absorb heat and keep the gas warmer. Additionally, surface treatments such as coatings or paints can also be used to alter the emissivity of the slat 30, which can impact the amount of radiation emitted from the surface and the rate of heat transfer.

Figure 3:
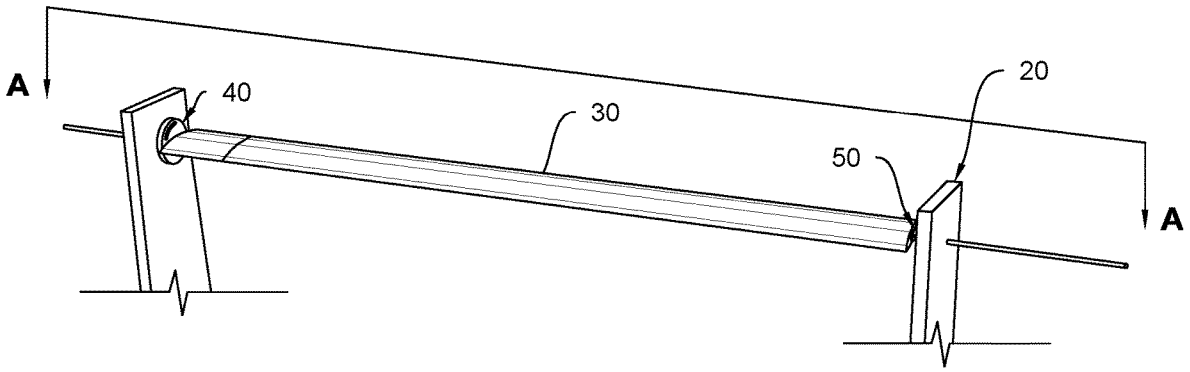
FIG. 3 is a representation of a partially broken view of at least one slat attached to the frame.

Referring now to FIG. 3, it shows a broken operational view of the at least one slat 30 attached to the frame 20. Moving to FIG. 4, it depicts a cross sectional view of the slat 30, frame 20, movable assembly 40 and fixing assembly 50. It can be observed that the movable assembly 40 and the fixing assembly 50 are partially enclosed by the slat 30. The movable assembly 40 may be located at a distal end of the at least one slat 30. The fixing assembly 50 may be located at an opposite distal end of the slat 30. Both the movable and fixing assembly provide sealing to the slat 30 by means of the sealing assembly 70 to ensure that the gas G does not leak to the outside.

Figure 4:
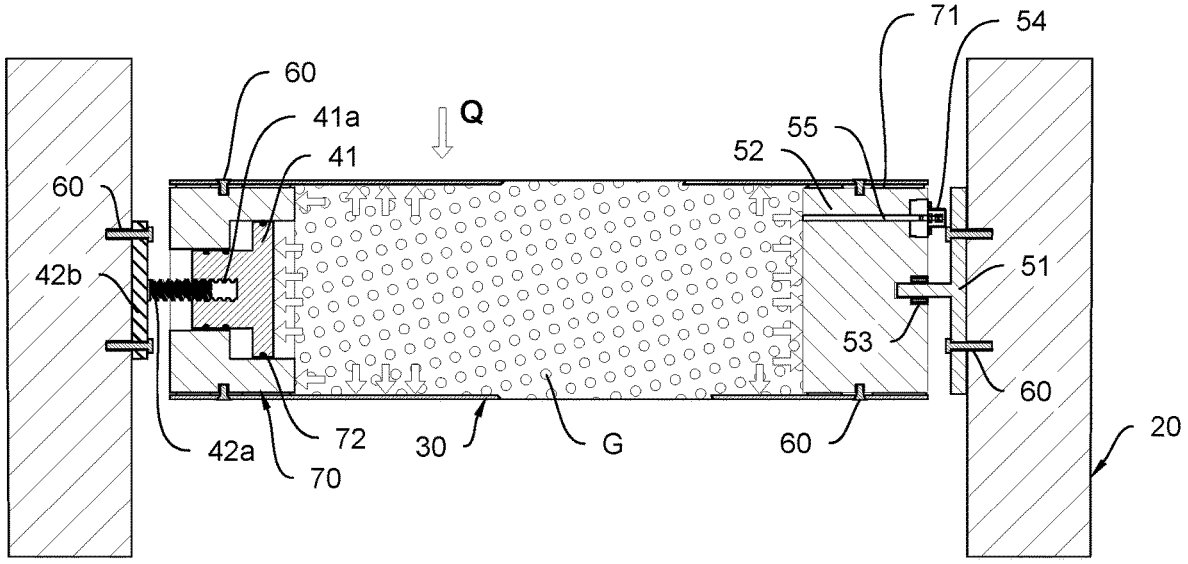
FIG. 4 is a cross sectional view from lines A-A of FIG. 3.

The movable assembly 40 may include a pressure sensitive element 41, a receiving member 42, and a first pressure retaining body 43. The movable assembly 40 may be made of any durable and lightweight material. In one embodiment, the first pressure retaining body 43 may act as a support to further receive the pressure sensitive element 41. As depicted in FIG. 4, the first pressure retaining body 43 may be inserted inside the slat 30, for it to tightly fit therein. The first pressure retaining body 43 may have a geometry that conforms to the inner shape of the slat 30. In an exemplary embodiment, wherein the slat 30 may have the aforesaid oval cross-section with pointed distal ends, the first pressure retaining body 43 may too have an oval cross-section with pointed distal ends and may be sized to fit inside the slat 30. The foregoing is mentioned for exemplary purposes, and does not limit neither the slat 30 nor the first pressure retaining body to have a specific geometry, as it may be subject to its operational requirements. Additionally, a combination of fasteners 60 and silicone seals 71 may be used to affix and seal the first pressure retaining body 43 inside the slat 30. It should be understood that the first pressure retaining body is pressed inside the slat 30. In one embodiment, the first pressure retaining body 43 may have an inner cut that conforms with the shape of the pressure sensitive element 41 to receive it therein as depicted in FIG. 4. The pressure sensitive element 41 may have a top portion having a planar surface that faces the interior of the slat 30. The planar surface of the pressure sensitive element 41 may be in direct contact with the gas G stored inside the slat 30. The pressure sensitive element 41 may have a bottom portion, which may have a smaller diameter than the top portion. However, in other exemplary embodiments, the pressure sensitive element 41 may have other suitable shapes whereon its geometry may be regular or irregular, such that it fits inside the first pressure retaining body 43. The pressure sensitive element 41 may have a mating thread 41*a* within the bottom portion thereof. Said mating thread 41*a* may consist of a series of grooves or channels that match the shape and spacing of a male thread. O-rings 72 from the sealing assembly 70, may be used around the pressure sensitive element 41 to prevent the leakage of the gas G stored inside the slat 30. As widely known, O-rings are typically made from elastomers, such as rubber or silicone, and are designed to fit snugly between two surfaces, forming a seal that is resistant to pressure, temperature, and chemical exposure. In other embodiments, other suitable seals from the art may be used, such as lip seals, v-ring seals, mechanical seals, or the like. When compressed between the two surfaces, in this case, the inner surface of the first pressure retaining body 43 and the outer surface of the pressure sensitive element 41, the O-ring deforms and fills any gaps or irregularities in the surfaces, creating a secure and reliable seal. It then should be understood that the pressure sensitive element 41 may be pressed inside the first pressure retaining body 43. The concatenation of the pressure sensitive element 41, the first pressure retaining body 43, and the slat 30 allows to create a chain of movement that may start in the pressure sensitive element 41 and may have an effect on the slat 30. The receiving member 42 may have a threaded portion 42*a* and a base 42*b* with slots 42*c*. Wherein the slots 42*c* may permit to adjust the initial position of the slat 42*c*. In exemplary FIGS. 6A-6B, the slat 30 is shown in vertical and horizontal configuration. The threaded portion 41*a* may consist of a series of raised ridges or helical projections that wrap around the shaft thereof. The purpose of the threaded portion 42*a* is to fit snugly into the corresponding mating thread 41*a*, creating a secure and stable connection between the two parts. In one embodiment the threaded portion 42*a* may include a tapered thread, a multi-start thread, a buttress thread, and acme thread, or any suitable variation thereof. In another suitable embodiment, the geometric parameters of the thread (such as its outer diameter, inner diameter, pitch diameter, pitch, depth) may be designed based on the intended application. The receiving member 42 may be threadedly connected to the pressure sensitive member 41 by means of the mating thread 41*a* and the threaded portion 42*a*.

Figure 5:
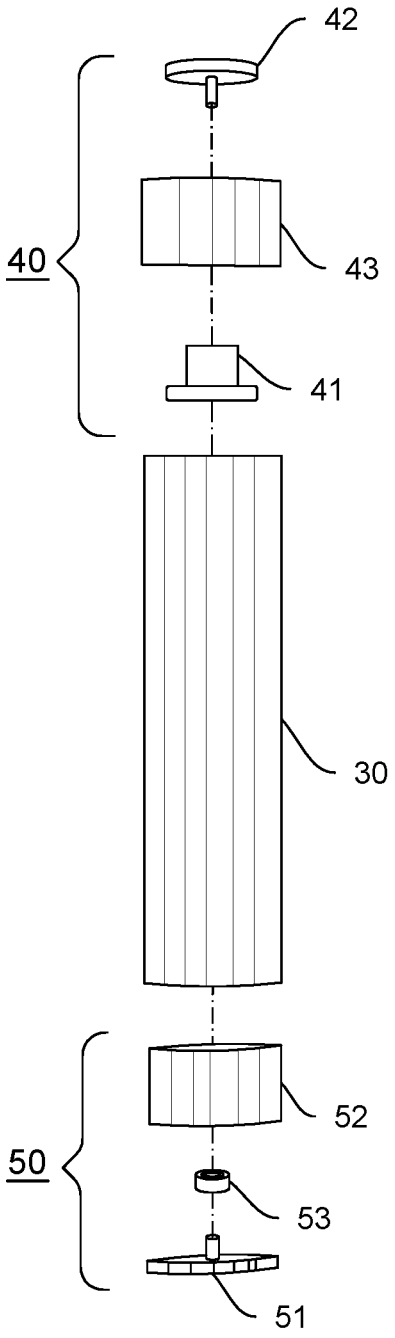
FIG. 5 is an exploded view of an exemplary embodiment of the present invention.

The fixing assembly 50 may include a fixing bracket 51 which may be formed by a base and a pivot axis. The base of the fixing bracket 51 may be attached to the frame 20 by means of fasteners as shown in exemplary FIG. 4. The fixing assembly may include a bearing 53 attached to the pivot axis of the fixing bracket 51. Additionally, the fixing assembly 50 may include a second pressure retaining body 52. The second pressure retaining body 52 may have a geometry that conforms to the inner shape of the slat 30. In an exemplary embodiment, wherein the slat 30 may have the aforesaid oval cross-section with pointed distal ends, the second pressure retaining body 52 may too have an oval cross-section with pointed distal ends and may be sized to fit inside the slat 30. The foregoing is mentioned for exemplary purposes, and does not limit neither the slat 30 nor the second pressure retaining body to have a specific geometry, as it may be subject to its operational requirements. Additionally, a combination of fasteners 60 and silicone seals 71 may be used to affix and seal the second pressure retaining body 52 inside the slat 30. It should be understood that the second pressure retaining body 52 is pressed inside the slat 30. The second pressure retaining body 52 may have a cut at distal end to receive the fixing bracket 51 and the bearing 53. Whilst the movable assembly acts as the driver that adjusts the angle of the slat 30 from an initial position to a final position, the fixing assembly 50 is used to provide support and stability to the slat 30. Exemplary FIG. 5 shows an exploded view of the movable assembly 40, the slat 30 and the fixing assembly 50. In one exemplary embodiment, the fixing assembly 50 may include a charging valve 54 that may be internally placed within said second pressure retaining body 52 as shown in FIG. 4. Wherein the charging valve 54 may be further connected to a distal end of an inner channel 55 formed within a cross section of the second pressure retaining body 52. The inner channel 55 may have an opposite distal end that leads to the interior of the slat. The charging valve 54 may control the flow of the gas G into the slat 30. It allows for the charging or pressurization of the system with the desired gas. The charging valve 54 ensures that the gas G is introduced in a controlled manner, regulating the pressure and flow rate to meet the specific requirements of the system. In a preferred embodiment, the charging valve 54 may be a one-way valve not to allow gas from leaking to the surroundings through it. In various embodiments, the charging valve 54 may be a needle valve, a ball valve, a diaphragm valve, a gate valve or any other suitable changing valve as known in the art.

As shown in FIG. 4 the gas may be stored within the slat 30 and sealed therein by means of the sealing assembly 70 in concert with both the first and second pressure retaining body (43 and 52). In order to provide shade, the present invention must interact with sunlight, thus, heat Q is entered into the system. Furthermore, it is a natural property of gasses to expand when heat is applied. This is known as thermal expansion and is a fundamental property of all matter, including gasses. When heat Q is applied to the gas G, the molecules in the gas G begin to move more rapidly and with greater energy. This increased energy causes the molecules to push apart from each other, which in turn causes the gas G to expand and occupy a larger volume. This process is governed by the Ideal Gas Law, which states that the pressure, volume, and temperature of a gas are all interrelated and can be used to calculate the behavior of a gas under different conditions. The extent to which the gas G expands when heated depends on a variety of factors, including the initial temperature and pressure of the gas G, the amount of heat applied, and the specific properties of the gas G molecules. Some gasses are more responsive to changes in temperature than others, and may expand or contract at different rates depending on the conditions. On the foregoing, the initial position of the slat 30 may be subject to initial temperature and pressure of the gas G. Pressure built inside the slat 30 due to gas expansion, may cause a pressure upon the inner surface of the slat 30, and specially on the pressure sensitive element 41. Such a pressure may push the pressure sensitive element 41 causing the mating thread to engage with the threaded portion 42*a*. The engagement of the mating thread 41*a* may rotate the pressure sensitive element 41, therefore, causing the slat 30 to rotate to adjust the angle of the slat as desired. Wherein the initial angle of the slat is defined by the position of the slat upon assembly thereof and the initial conditions of the gas as no heat is applied. The final position of the slat 30 is defined when the mating thread 41*a* completely engages to said threaded portion 42*a*. When heat Q is no longer applied to the system, the gas G may cool inside the slat 30, its molecules may lose energy and move more slowly. As a result, the gas G may contract and occupy a smaller volume. This is because the pressure of the gas G is determined by the number of molecules and their average speed, so a decrease in speed means a decrease in pressure. It may be sought for the gas G to create a vacuum inside the slat 30 upon cooling to disengage the mating thread 41*a* from the threaded portion 42*a* in the process. In order for a gas to create a vacuum inside the slat 30 when it cools, the slat 30 must be completely sealed and the gas G must be able to contract to a volume smaller than the original volume of the system. In one embodiment, the present invention 10 may include a valve (not shown in the drawings) to prevent deformation of the slat 30 during expansion/contraction of the gas G.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An automatic shade actuating system, comprising:

a supporting structure;

at least one slat mounted to said supporting structure, said at least one slat having a movable assembly located at a first distal end thereof and a fixing assembly at a second distal end thereof, said at least one slat is connected to said supporting structure at said distal ends, said at least one slat further encloses a gas;

the movable assembly includes a pressure sensitive element threadedly connected to a receiving member, wherein said pressure sensitive element rotates the at least one slat when engaging said receiving member;

the fixing assembly includes a fixing bracket with a pivot axis that supports rotation of said at least one slat;

wherein a heat applied to the system causes the system to:

vary a pressure inside the slat;

said varied pressure actuates said pressure sensitive element, and wherein rotation of said pressure sensitive element changes a shade angle of said at least one slat.

2. The automatic shade actuating system of claim 1, wherein said movable assembly includes a first pressure retaining body which is coupled and sealed within said at least one slat at said first distal end, said first pressure retainer body conforms with a cross-section of said at least one slat.

3. The automatic shade actuating system of claim 2, wherein said first pressure retaining body has a central cut to receive said pressure sensitive element therein.

4. The automatic shade actuating system of claim 1, wherein said fixing assembly includes a second pressure retaining body which is coupled and sealed within said at least one slat at said second distal end, said second pressure retaining body conforms with a cross-section of said at least one slat.

5. The automatic shade actuating system of claim 4, wherein said second retaining body receives said pivot axis of said fixing bracket.

6. The automatic shade actuating system of claim 1, wherein a base of said receiving member and a base of said fixing bracket are secured onto said supporting structure by means of fasteners.

7. The automatic shade actuating system of claim 1, wherein said pressure sensitive element has a top portion that faces an interior of the at least one slat and a mating thread that faces said threaded portion, said mating thread is further aligned with the threaded portion.

8. The automatic shade actuating system of claim 4, wherein said second pressure retaining body includes a charging valve that is internally connected to an inner channel, wherein the inner channel is formed in a cross-section of the second pressure retaining body.

9. An automatic shade actuating system, comprising:

a supporting structure;

at least one slat mechanically connected to said supporting structure by means of fasteners, wherein said at least one slat encloses a gas;

a movable assembly located at a distal end of said at least one slat, said movable assembly including a pressure sensitive element threadedly connected to a receiving member, wherein said pressure sensitive element is located inside the at least one slat to be actuated by said gas, said receiving member is further attached to said supporting structure by means of fasteners, a periphery of said pressure sensitive element is sealed and pressed against an interior of the at least one slat so that rotation of the pressure sensitive element causes the at least one slat to rotate;

a fixing bracket with pivot axis that allows said at least one slat to rotate;

when a heat source is applied to the at least one slat said gas expands, thereby pushing a mating portion of said pressure sensitive element towards a threaded portion of the receiving member, the pressure applied by the gas during expansion drives the pressure sensitive element to rotate, rotation of the pressure sensitive element causes the rotation of said at least one slat from an initial position to a final position; when said gas cools, the gas contracts creating a vacuum inside the at least one slat, thereby rotating the pressure sensitive element to angle the at least one slat to said initial position.

* * * * *